US007597497B2

(12) United States Patent
Levine

(10) Patent No.: US 7,597,497 B2
(45) Date of Patent: Oct. 6, 2009

(54) SINGLE DOSE TOOTH WHITENER DISPENSER AND APPLICATOR, AND METHOD OF TOOTH WHITENING

(75) Inventor: Jonathan B Levine, Purchase, NY (US)

(73) Assignee: Gosmile, Inc., Berkeley, CA (US)

( * ) Notice: Subject to any disclaimer, the term of this patent is extended or adjusted under 35 U.S.C. 154(b) by 346 days.

(21) Appl. No.: 11/187,542

(22) Filed: Jul. 25, 2005

(65) Prior Publication Data

US 2007/0020028 A1 Jan. 25, 2007

(51) Int. Cl.
*B05C 21/00* (2006.01)
*B43K 5/14* (2006.01)

(52) U.S. Cl. ..... 401/202; 401/133; 401/134

(58) Field of Classification Search ..... 401/183–186, 401/196, 202, 205, 206, 207, 133, 134
See application file for complete search history.

(56) References Cited

U.S. PATENT DOCUMENTS

| | | | | |
|---|---|---|---|---|
| 1,949,976 | A * | 3/1934 | Runnels | 401/202 |
| 3,135,007 | A * | 6/1964 | Howell | 401/202 |
| 3,271,810 | A * | 9/1966 | Raffe | 401/132 |
| 3,482,920 | A * | 12/1969 | Schwartzman | 401/132 |
| 3,972,331 | A | 8/1976 | Bolduc et al. | |
| 4,927,283 | A | 5/1990 | Fitjier | |
| 5,307,953 | A | 5/1994 | Regan | |
| 6,517,350 | B2 | 2/2003 | Diasti et al. | |
| 2002/0064753 | A1 | 5/2002 | Philp, Jr. | |
| 2003/0198918 | A1 | 10/2003 | Dragan et al. | |
| 2004/0067090 | A1 | 4/2004 | Budds et al. | |
| 2007/0009857 | A1 | 1/2007 | Philp, Jr. et al. | |

FOREIGN PATENT DOCUMENTS

| | | |
|---|---|---|
| GB | 929331 | 6/1963 |
| WO | WO-2004108003 | 12/2004 |
| WO | WO-2004108004 | 12/2004 |

* cited by examiner

*Primary Examiner*—David J Walczak
(74) *Attorney, Agent, or Firm*—Marshall, Gerstein & Borun LLP

(57) ABSTRACT

A single dose hygienic tooth whitener dispenser and applicator has a chamber. The housing is a bottle having an upper end with a neck and threads receiving a threaded sleeve. The sleeve includes a recess receiving a sponge applicator having a bottom surface overlying an upwardly facing opening of the chamber in the bottle. This opening is initially covered by a hermetic seal. An over-cap includes a bottom facing opening slidable over the sleeve and covers the applicator. Within the over-cap, a pin extends downwardly. The pin has a pointed end facing downward. When it is desired to use the inventive device to whiten the user's teeth, the over-cap is pushed down until the pointed end of the pin extends through the applicator and pierces the seal in the opening of the bottle, whereupon tooth whitener may be dispensed and applied.

19 Claims, 2 Drawing Sheets

SINGLE DOSE TOOTH WHITENER DISPENSER AND APPLICATOR, AND METHOD OF TOOTH WHITENING

BACKGROUND OF THE INVENTION

The present invention relates to a single dose tooth whitener dispenser and applicator, and method of tooth whitening.

Kits permitting people to whiten their teeth in the comfort and privacy of their own homes are becoming more and more popular. In designing such home use kits, it is important to keep in mind how the average consumer will use such a product. In order to ensure that the customer uses a product for which cleanliness and sterility are assured, it is advantageous to provide the product with a volume of tooth whitener that constitutes a "single dose" thereof. In this way, after the single dose is used, its applicator may be discarded without being re-used.

In a further aspect, it is desirable to hermetically seal the single dose of tooth whitener within a container. Such hermetic sealing requires an easy way to break the seal. Where glass ampules are used, there is always the danger of shards of glass being embedded in the user's hand. In products where glass ampules are employed, it is, thus, important to provide some shielding structure separating the user's hands from the ampule. It would be, however, advantageous to simplify the proposed structure of a tooth whitening dispenser and applicator to avoid the need for use of shielding structure. As such, where possible, it would be advantageous to make a sealed chamber containing a single dose of tooth whitener of a material that will not shatter or break, and that need not be shattered or broken to allow access to the single dose of tooth whitener.

It would also be advantageous to provide a simple means that the home user could employ to break a seal of a single dose container to allow dispensing of tooth whitener. Advantageously, such a device should somehow be connected to the chamber in which the single dose is contained so that the structure for breaking the seal will not be misplaced or lost.

It would be advantageous to provide such a device including an effective applicator tip allowing application of tooth whitener in a smooth and efficient manner, covering all of the surfaces of the user's teeth while avoiding exposing the gums and other mouth tissues to the active ingredients of a tooth whitening substance.

Finally, it would be advantageous to provide such a device with portability allowing application of tooth whitener at the home, office, or even while traveling.

It is with the above issues in mind that the present invention was developed.

The following prior art is known to Applicant:

United States Published Application No. US 2003/0198918 to Dragan et al. discloses a dental material container with a porous flow-through applicator. The embodiment illustrated in FIG. 14 discloses such a container having a foam ball covering its opening, with the opening being initially closed. As disclosed, the closed or sealed end of the discharge nozzle may be pierced by a suitable piercing tool to form a discharge orifice through which the dental material may be dispensed as it forms through the porous cover. The present invention differs from the teachings of Dragan et al. as contemplating a single dose container having a seal covered by a porous applicator where the piercing member for the porous applicator consists of an over-cap overlying the applicator tip, and wherein a piercing member is projected through the applicator tip, whereupon it pierces the sealed opening to allow flow of tooth whitener through the applicator tip.

U.S. Pat. No. 5,307,953 to Regan discloses a single dose dispenser for a flowable substance, for example, for intranasal administration of a liquid drug. In Regan, a cap covering the single dose container includes a hollow piercing member that pierces a seal to allow flow of the liquid contained within the single dose container. In Regan, the liquid flows through the piercing member. The present invention differs from the teachings of Regan as contemplating a porous applicator, and wherein the piercing member does not double as a conduit through which liquid flows.

U.S. Pat. No. 3,972,331 to Bolduc et al. discloses a dispensing catheter for injecting fluids into the canal of a fallopian tube. Bolduc et al. contemplate a piercing member designed to pierce a seal allowing flow of medication. However, Bolduc et al. fail to teach the concept of a porous applicator, and wherein the liquid flows through the porous applicator rather than through a piercing member.

U.S. Pat. No. 4,927,283 to Fitjer discloses an applicator device including a puncturing means. The Fitjer device includes an elongated handle and a sponge end separated from a chamber filled with material by a seal. An elongated mandrel may be reciprocated from the proximal end of the handle to pierce the seal and allow liquid to flow through a porous applicator. The present invention differs from the teachings of Fitjer as contemplating piercing a seal allowing flow of liquid from a chamber with the piercing being accomplished from a side of the device opposite to the chamber where the liquid is located.

SUMMARY OF THE INVENTION

The present invention relates to a single dose tooth whitener dispenser and applicator, and method of tooth whitening. The present invention includes the following interrelated objects, aspects and features:

(1) In a first aspect, the present invention contemplates a housing having a chamber sized to contain a single dose of hygienic tooth whitener hermetically sealed therein. In a first embodiment, illustrated in FIGS. 1-5, the housing comprises a bottle-like structure having an upper end with a narrowed neck and external threads designed to receive a threaded sleeve.

(2) The threaded sleeve includes an upwardly open recess that receives a sponge applicator. The applicator has a tip sized and configured to enable the user to target application of tooth whitener on the teeth while avoiding the coating of surrounding soft tissues. The sponge applicator has a bottom surface overlying an upwardly facing opening of the chamber in the housing. This opening is initially covered by a hermetic seal facilitating hermetical sealing of the chamber of the housing.

(3) In the first embodiment, an over-cap includes a bottom facing opening that is expandable through the inclusion of a plurality of slots so that the over-cap may slide over the threaded sleeve and cover the sponge applicator. Within the over-cap, an elongated pin extends downwardly in a direction aligned with the axis of elongation and movement of the over-cap. The pin has a pointed end facing downward toward and extending into the sponge applicator in the initial position of the over-cap.

(4) In a second embodiment, the threaded sleeve has a thinner wall and smaller diameter. The over-cap slides over the threaded sleeve and is initially held in a position with its elongated pin spaced over the sponge applicator by the combination of an annular groove in the over-cap engaging an annular bead about the periphery of the threaded sleeve. Of course, if desired, these structures may be reversed with the threaded sleeve having an annular groove and the internal wall of the over-cap having an inwardly facing annular bead.

(5) When the over-cap is pushed downwardly to pierce the sponge applicator and then the seal in the opening of the body, an annular skirt defining the bottom of the over-cap engages an angular surface on the bottle-like structure to stop downward movement. In the second embodiment, the bottom termination of the over-cap is unslotted.

(6) When it is desired to use either embodiment of the inventive device to whiten the user's teeth, the over-cap is pushed down until the pointed end of the pin in the over-cap pierces the seal in the opening of the bottle. Thereafter, the over-cap is removed from the bottle and the bottle may be squeezed to cause tooth whitener to flow into the sponge applicator, whereupon the inventive dispenser and applicator may be employed to apply a single dose of tooth whitener targeted to the user's teeth.

(7) The physical dimensions of the sponge applicator are specifically designed to facilitate coating the user's teeth with tooth whitener while avoiding application of tooth whitener to the user's gums or other tissues of the mouth.

(8) In the embodiments of the present invention, the housing or bottle of the present invention is made of a flexible plastic material. The inwardly threaded sleeve may be made of any suitable plastic or metal, and the sponge applicator is preferably made of a synthetic foam material to best facilitate maintenance of sterility and cleanliness. The pin within the over-cap may be made of any suitable metal or plastic as is the case with the over-cap itself.

As such, it is a first object of the present invention to provide a single dose hygienic tooth whitener dispenser and applicator, and method of tooth whitening.

It is a further object of the present invention to provide such a device in which a single dose of tooth whitener is contained within a resilient bottle.

It is a still further object of the present invention to provide such a device wherein a sponge-type applicator overlies an opening of the bottle initially sealed by a seal, the applicator being sized and configured to avoid unwanted application of tooth whitener to soft tissues.

It is a still further object of the present invention to provide such a device in which an over-cap is provided with a downwardly depending pin that may be reciprocated with the over-cap to break the seal and allow dispensing and application of tooth whitener.

These and other objects, aspects and features of the present invention will be better understood from the following detailed description of the preferred embodiment when read in conjunction with the appended drawing figures.

SPECIFIC DESCRIPTION OF THE PREFERRED EMBODIMENTS

Figure 1:
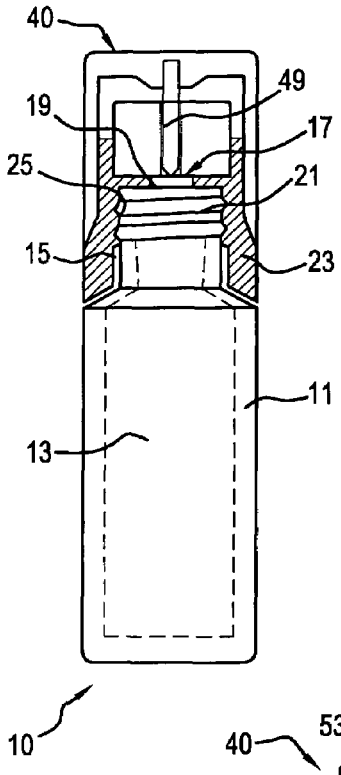
FIG. 1 shows a side view, partially in cross-section, of a first embodiment of the present invention in a first orientation thereof.
Figure 2:
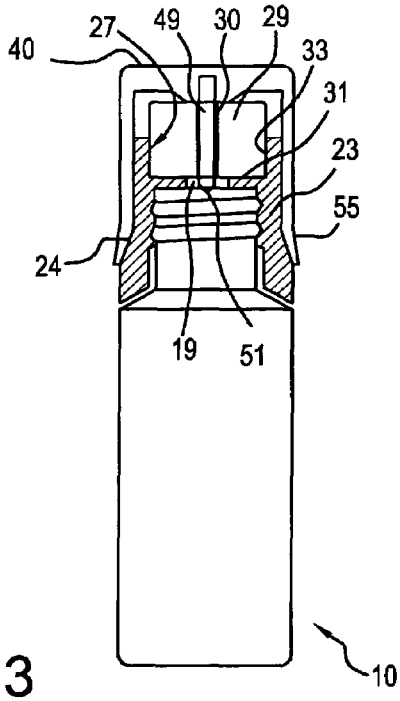
FIG. 2 shows a view similar to that of FIG. 1, but in a second orientation thereof.
Figure 3:
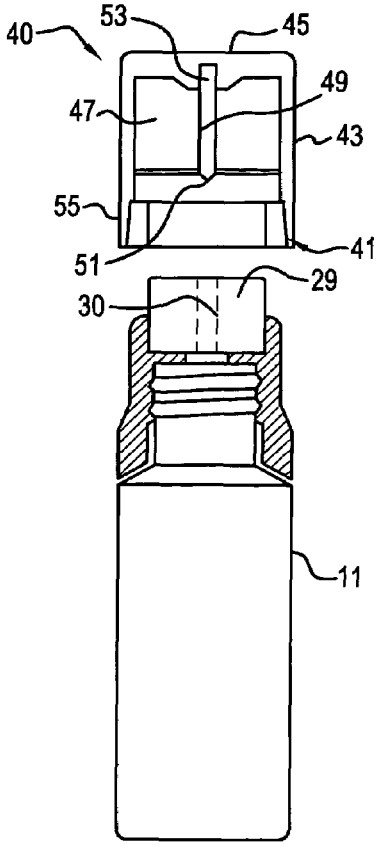
FIG. 3 shows an exploded side view, partially in cross-section, of the first embodiment of the present invention.

With reference, first, to FIGS. 1-3, a first embodiment of the present invention is generally designated by the reference numeral 10, and is seen to include a housing 11 in the form of a bottle having an internal chamber 13 sized to receive a single dose of tooth whitener. The bottle 11 includes a neck 15 having an upwardly facing opening 17, initially sealed by a hermetic seal 19, permitting the chamber 13 to be hermetically sealed to preserve the viability of the hygienic tooth whitener contained therein.

The neck 15 of the bottle 11 has external threads 21. A sleeve 23 has internal threads 25 configured to enmesh with the external threads 21 of the neck 15 of the bottle 11 so that the sleeve 23 may be threaded over the neck 15 as shown in FIGS. 1-3.

The sleeve 23 includes an upwardly open recess 27 sized to receive a sponge applicator 29. The recess 27 is composed of a bottom surface 31 and an annular side wall 33 as shown in FIGS. 1-3.

With reference, again, to FIGS. 1-3, the inventive device 10 includes an over-cap 40 having a bottom facing opening 41, an annular side wall 43, and a closed top 45. The over-cap 40 defines an internal chamber 47 in which a downwardly depending pin 49 is located, having a lowermost extend defined by a pointed end 51. The opposite end of the pin 49 is designated by the reference numeral 53, and is embedded in the top 45 of the cap 40 as shown in the figures. The pin 49 can be, for example, an elongate needle.

Figure 4:
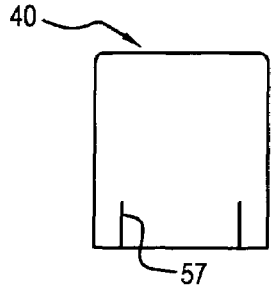
FIG. 4 shows a side view of the over-cap of the first embodiment of the present invention.
Figure 5:
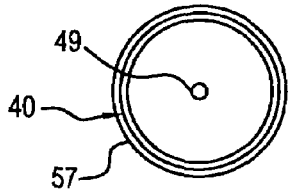
FIG. 5 shows a bottom view of the over-cap of FIG. 4.

Adjacent the opening 41, of the over-cap 40, a thinned skirt 55 is provided that includes a plurality of circumferentially spaced slits 57 (FIG. 4) that allow the skirt 55 to expand for a reason to be described in greater detail hereinafter. The splits 57 are also shown in FIG. 5.

With reference, now, to FIGS. 1 and 2, it is seen that in FIG. 1, the pointed tip 51 of the pin 49 within the over-cap 40 is spaced above the seal 19, hermetically sealing the contents in the chamber 13 of the bottle 11. When it is desired to dispense the contents of the bottle 11, the over-cap 40 is pushed downwardly as shown in FIG. 2 until the tip 51 of the pin 49 pierces the seal 19, thereby exposing the contents within the chamber 13 of the bottle 11. During the downward motion of the over-cap 40, the skirt 55 of the over-cap 40 rides along a conical surface 24 at the lower end of the sleeve 23. The splits 57 permit expansion of the skirt 55 to perform this function.

After the pointed tip 51 of the pin 49 has pierced the seal 19, the over-cap 40 is removed as shown in FIG. 3 so that the sponge applicator 29 is exposed. The bottle 11 may be squeezed to cause the applicator 29 to be impregnated with tooth whitener that may then be applied to the teeth (not shown) of the user.

Looking, again, at FIGS. 1 and 2, it is important to note that the movement of the pin 49 in a direction to pierce the seal 19 is through the sponge applicator via an elongated hole 30 formed therethrough (FIGS. 2 and 3). The sponge material of the applicator 29 is made of a material such that once the pin 49 is removed from the opening 30 in the sponge applicator 29, the dimensions of the opening 30 diminish so that the majority of tooth whitener dispensed or applied by the sponge applicator 29 is applied by virtue of flow of the tooth whitener through the sponge applicator 29 rather than through the opening 30.

Figure 6:
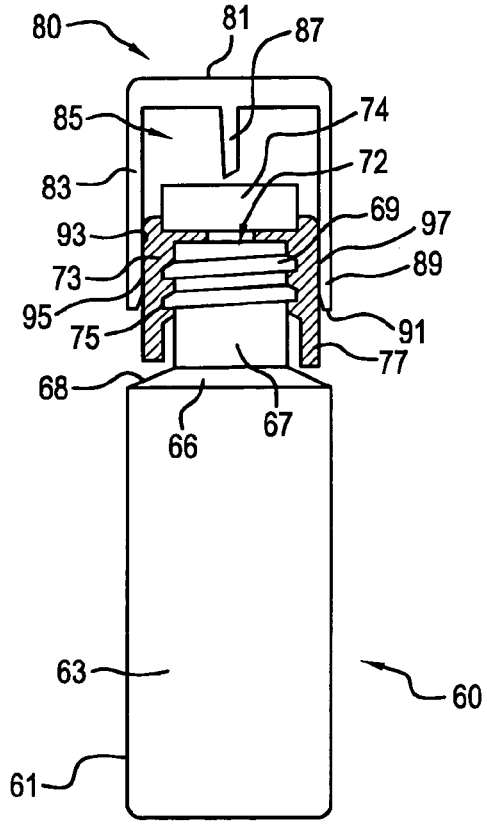
FIG. 6 shows a side view, partially in cross-section, of a second embodiment of the present invention with the over-cap thereof in its upper position.
Figure 7:
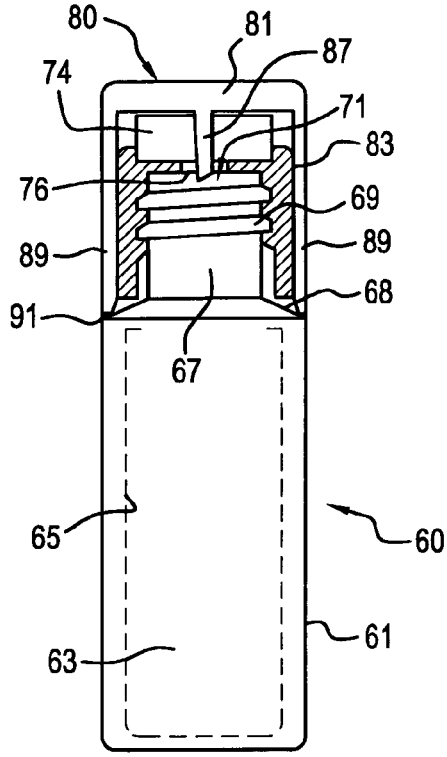
FIG. 7 shows the embodiment of FIG. 6 with the over-cap in its lower position.

In a second embodiment of the present invention, illustrated in FIGS. 6-7, the inventive dispenser and applicator is generally designated by the reference numeral 60. The device 60 includes a housing 61, consisting of a bottle 63 having an internal chamber 65 as shown in phantom in FIG. 7 as well as a neck 67 having external threads 69 and an upwardly facing opening 71. A sleeve 73 includes internal female threads 75 that enmesh with the threads 69 of the neck 67 when the sleeve 73 is threaded thereover.

The bottle 61 includes a transition 66 between the chamber 63 and neck 67 that includes frustoconical surface 68. The sleeve 73 includes a downwardly depending skirt 77 that, as illustrated in FIGS. 6-7, is located adjacent the surface 68 as installed.

An over-cap 80 includes a top surface 81, a periphery 83, and an internal chamber 85 in which a downwardly depending pin 87 is located. The periphery 83 includes a downwardly depending skirt 89 that terminates at a bottom surface 91. The skirt 89 is unslotted.

With reference to FIG. 6, the skirt 89 has an internal wall 93 including an annular groove 95. The periphery of the sleeve 73 includes an annular bead 97 sized to engage the annular groove 95 of the over-cap 80 in the position shown in FIG. 6. The interaction between the groove 95 and bead 97 maintains the over-cap 80 in the position shown with the pin 87 suspended above the sponge applicator 74.

When it is desired to use the inventive device 60, with reference to FIG. 7, the over-cap 80 is pushed downwardly overcoming the interaction between the groove 95 and bead 97 so that the pin 87 pierces the sponge applicator 74 as well as the hermetic seal 76 sealing the opening 71 of the neck 67 of the bottle 61. Downward movement of the over-cap 80 is limited by engagement of the bottom surface 91 of the skirt 89 of the over-cap 80 with the frustoconical surface 68 of the bottle 61 as shown in FIG. 7. Thereafter, as before, the over-cap 80 may be removed and the sponge applicator 74 may be employed to apply tooth whitener to the user's teeth.

Thus, with the structures and functions of the inventive devices 10 and 60 having been described in detail, the method of whitening teeth using the devices 10 or 60 should be self-evident. The bottle 11 or 61 is filled with a single dose of tooth whitening liquid and the seal 19 or 76 is applied while the chamber 13 or 63 is evacuated to vacuum pack the tooth whitener therewithin. The sleeve 23 or 73 is threaded over the neck 15 or 67 of the bottle 11 or 61 and the over-cap 40 or 80 is placed thereover in the position shown in FIGS. 1 or 6.

When it is desired to whiten the teeth of the user, the over-cap 40 or 80 is pushed downwardly as shown in FIGS. 2 or 7 to cause the pin 49 or 87 to pierce the seal 19 or 76. During this motion, in the embodiment of FIGS. 1-5, the skirt 55 expands over the conical surface 24 of the sleeve 23 with the splits 57 in the over-cap 40 opening and facilitating this movement. In the embodiment of FIGS. 6-7, the unslotted skirt 89 of the over-cap 80 descends downwardly until downward movement is stopped through engagement of the bottom surface 91 thereof with the frustoconical surface 68 of the bottle 61.

Thereafter, the over-cap 40 or 80 is removed exposing the sponge applicator 29 or 74. The bottle 11 or 61 may be squeezed to enhance delivery of tooth whitener to and through the sponge applicator, whereupon the sponge applicator may be employed to coat the user's teeth with the tooth whitening substance. The configuration of the sponge applicator limits the amount of tooth whitener that might coat the soft tissues of the mouth.

In the embodiments of the present invention, the bottle is made of a flexible, resilient plastic material allowing it to be squeezed to enhance delivery of tooth whitener. The sponge applicator is preferably made of a synthetic sponge material rather than a natural sponge material to enhance sterility. The sponge material of the applicator is made of sufficient density so that once the pin is removed from the opening, the opening narrows to preclude free flow of tooth whitener therethrough. Thus, the predominant amount of tooth whitener soaks through the sponge applicator.

The sleeve 23 or 73, over-cap 40 or 80, and pin 49 or 87 may be made of any suitable rigid, plastic or metal, or combination thereof.

As such, an invention has been disclosed in terms of preferred embodiments thereof, which fulfill each and every one of the objects of the invention as set forth hereinabove, and provide a new and useful single dose tooth whitener dispenser and applicator, and method of tooth whitening of great novelty and utility.

Of course, various changes, modifications and alterations in the teachings of the present invention may be contemplated by those of ordinary skill in the art without departing from the intended spirit and scope thereof.

As such, it is intended that the present invention only be limited by the terms of the appended claims.

The invention claimed is:

1. A dispenser and applicator for liquid, comprising:

a) a container having an internal chamber and an opening initially sealed by a seal such that liquid within said chamber is hermetically sealed therein;

b) a porous applicator mounted on said container above said opening and overlying said seal;

c) an over-cap covering said applicator and opening, said over-cap being movable with respect to said container and carrying a piercing member;

d) said over-cap being movable from a position at which said piercing member is spaced from said seal to a position at which said piercing member extends through said applicator and pierces said seal, wherein the porous applicator comprises an opening sized to receive the piercing member, the piercing member is disposed in the opening when the piercing member is spaced from the seal, and the porous applicator is formed of a material having a sufficiently high density that the opening narrows when the piercing member is removed from the opening, to preclude free flow of liquid through the opening.

2. The dispenser and applicator of claim 1, wherein said container comprises a bottle.

3. The dispenser and applicator of claim 1, wherein said porous applicator comprises a sponge.

4. The dispenser and applicator claim 3, wherein a sleeve is mounted over said container, surrounding said opening, and said sponge is supported by said sleeve.

5. The dispenser and applicator of claim 4, wherein said container comprises a bottle with a neck surrounding said opening, said neck includes external threads, said sleeve having internal threads enmeshing with said external threads of said neck to mount said sleeve on said neck.

6. The dispenser and applicator of claim 5, wherein said over-cap is reciprocable over said sleeve.

7. The dispenser and applicator of claim 6, wherein said piercing member comprises an elongated needle.

8. The dispenser and applicator of claim 7, wherein said over-cap moves along an axis of movement, said needle being aligned with said axis of movement.

9. The dispenser and applicator of claim 8, wherein said over-cap has a bottom facing opening with a surrounding skirt.

10. The dispenser and applicator of claim 9, wherein said sleeve has an annular tapered outer surface, said skirt engaging said outer surface when said over-cap reciprocates over said sleeve.

11. The dispenser and applicator of claim 10, wherein said skirt has at least one split permitting said skirt to expand as it reciprocates over said outer surface of said sleeve.

12. The dispenser and applicator of claim 9, wherein said container includes a frustoconical surface, said surrounding skirt engaging said frustoconical surface to limit downward movement of said over-cap.

13. The dispenser and applicator of claim 12, wherein said surrounding skirt is unslotted.

14. The dispenser and applicator claim 12, wherein said sleeve includes an external wall having an outwardly extending annular bead, said over-cap including an internal surface with an annular groove, said bead being retained within said groove when said over-cap is at said position at which said piercing member is spaced from said seal.

15. The dispenser and applicator of claim 1, wherein said container is resilient and squeezable.

16. The dispenser and applicator of claim 1, wherein said over-cap is reciprocable with respect to said container.

17. The dispenser and applicator of claim 16, wherein said piercing member comprises an elongated needle.

18. The dispenser and applicator of claim 17, wherein said over-cap moves along an axis of movement, said needle being aligned with said axis of movement.

19. The dispenser and applicator claim 1, wherein said liquid comprises tooth whitener.

* * * * *